US009797264B2

(12) United States Patent
Boeck

(10) Patent No.: US 9,797,264 B2
(45) Date of Patent: Oct. 24, 2017

(54) ROTATING BLADE HAVING A RIB ARRANGEMENT WITH A COATING

(71) Applicant: MTU Aero Engines GmbH, Munich (DE)

(72) Inventor: Alexander Boeck, Kottgeisering (DE)

(73) Assignee: MTU AERO ENGINES GmbH, Munich (DE)

( * ) Notice: Subject to any disclaimer, the term of this patent is extended or adjusted under 35 U.S.C. 154(b) by 1353 days.

(21) Appl. No.: 13/709,322

(22) Filed: Dec. 10, 2012

(65) Prior Publication Data

US 2013/0149165 A1 Jun. 13, 2013

(30) Foreign Application Priority Data

Dec. 13, 2011 (EP) ..... 11193177

(51) Int. Cl.

| | |
|---|---|
| ***F01D 5/28*** | (2006.01) |
| ***F01D 5/22*** | (2006.01) |
| ***F01D 11/08*** | (2006.01) |
| ***C23C 4/12*** | (2016.01) |
| ***C23C 24/04*** | (2006.01) |
| ***C23C 4/01*** | (2016.01) |

(52) U.S. Cl.

CPC ..... *F01D 5/288* (2013.01); *C23C 4/01* (2016.01); *C23C 4/12* (2013.01); *C23C 24/04* (2013.01); *F01D 5/225* (2013.01); *F01D 11/08* (2013.01); *F05D 2230/311* (2013.01); *F05D 2230/312* (2013.01); *F05D 2240/126* (2013.01)

(58) Field of Classification Search

CPC ..... F01D 5/225; F01D 5/288; F01D 11/08; F05D 2230/311; F05D 2230/312; F05D 2240/126; C23C 4/01; C23C 4/12; C23C 24/04

See application file for complete search history.

(56) References Cited

U.S. PATENT DOCUMENTS

| | | | | |
|---|---|---|---|---|
| 4,390,320 | A * | 6/1983 | Eiswerth | F01D 5/005 29/889.1 |
| 4,884,820 | A * | 12/1989 | Jackson | C21D 1/09 277/415 |
| 5,038,014 | A * | 8/1991 | Pratt | B22F 3/1055 219/121.64 |
| 5,453,329 | A * | 9/1995 | Everett | C23C 24/103 219/121.66 |
| 5,794,338 | A | 8/1998 | Bowden, Jr. et al. | |
| 6,190,124 | B1 * | 2/2001 | Freling | C23C 28/321 415/173.4 |

(Continued)

FOREIGN PATENT DOCUMENTS

| | | | |
|---|---|---|---|
| EP | 1083299 | A2 | 3/2001 |
| EP | 2372093 | A1 | 10/2011 |

(Continued)

*Primary Examiner* — Igor Kershteyn

(74) *Attorney, Agent, or Firm* — Barlow, Josephs & Holmes, Ltd.

(57) ABSTRACT

The present invention relates to a rotating blade (5), in particular for a compressor or turbine stage of a gas turbine, having a radially outer rib arrangement with at least one rib (2), onto which a coating (3) is disposed, whereby, in a meridian section, the coating (3) has an outer contour (3.1), which extends axially outwardly in the radial direction.

13 Claims, 1 Drawing Sheet

(56) References Cited

U.S. PATENT DOCUMENTS

Figure 1:
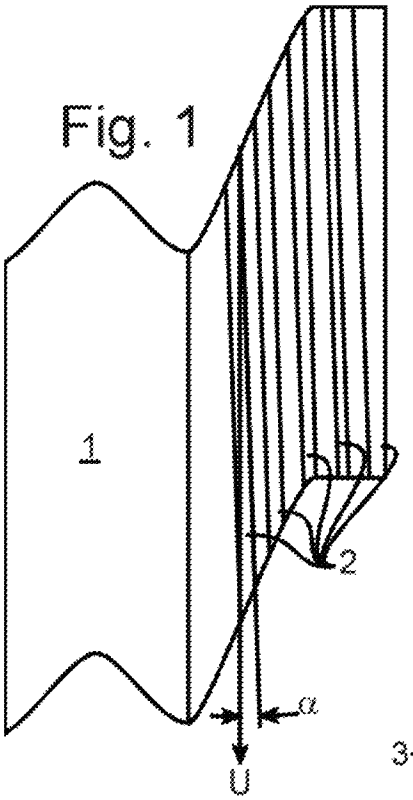

| | | | | |
|---|---|---|---|---|
| 6,224,337 | B1 * | 5/2001 | Lieland | F01D 5/18 415/173.4 |
| 6,478,304 | B1 * | 11/2002 | Hoffelner | F01D 11/02 277/415 |
| 6,558,119 | B2 * | 5/2003 | Lee | B23P 6/005 416/97 R |
| 6,939,104 | B2 * | 9/2005 | Chantal | F01D 5/225 415/173.1 |
| 7,587,818 | B2 * | 9/2009 | Gorman | B23P 6/007 148/525 |
| 8,740,572 | B2 * | 6/2014 | Hoebel | C23C 24/10 415/173.1 |
| 2001/0008230 | A1 * | 7/2001 | Keicher | B01F 13/0255 219/121.63 |
| 2006/0171813 | A1 | 8/2006 | Malak et al. | |
| 2007/0134096 | A1 | 6/2007 | Mons et al. | |

FOREIGN PATENT DOCUMENTS

| | | | |
|---|---|---|---|
| JP | 2005127276 | A | 5/2005 |
| WO | 2005061854 | A1 | 7/2005 |

* cited by examiner

ROTATING BLADE HAVING A RIB ARRANGEMENT WITH A COATING

BACKGROUND AND SUMMARY OF THE INVENTION

The present invention relates to a rotating blade, in particular for a compressor or turbine stage of a gas turbine, having a radially outer rib arrangement with at least one rib, onto which a coating is disposed; a turbomachine, in particular a gas turbine, having at least one such rotating blade; as well as a method for coating a rib arrangement of a rotating blade.

It is known from EP 1 550 741 A1 how to provide rotating blades with ribs radially outside in order to reduce the leakage gap relative to a surrounding, particularly honeycomb-shaped sealing surface, and thus to increase the efficiency of a gas turbine. The publication proposes to provide the ribs on the end face with an abrasive coating, which is enclosed in a sacrificial material of the sealing surface.

The object of the present invention is to provide an improved turbomachine.

To achieve this object, a rotating blade which can preferably be used in at least one compressor and/or turbine stage of a gas turbine is disclosed and a turbomachine, in particular a gas turbine, having a rotating blade arrangement with such rotating blades is disclosed; and a method for coating ribs of a rotating blade.

One aspect of the present invention is based on the idea of making available, by means of a rib coating, not, or not only, a harder, but (also) a larger surface.

For this purpose, a rotating blade has a radially outer rib arrangement with one or several ribs disposed behind one another, in particular in the axial direction. As the axial direction, presently a coordinate direction is particularly denoted that is flush with the axis of rotation of the rotating blade or turbomachine, in particular the gas turbine; as the radial direction, a direction is accordingly denoted that extends perpendicularly away from the axis of rotation; as the peripheral direction, a direction is denoted that extends perpendicular to the axis of rotation as well as the radial direction, in particular in the direction of rotation of the rotating blade or turbomachine, in particular the gas turbine.

A coating is disposed on at least one rib, preferably two or more ribs, in particular adjacent ribs, and preferably on all ribs of the rib arrangement. The coating is preferably produced from metal, plastic and/or ceramics; in a preferred embodiment, it has a greater hardness than the ribs themselves. In the present case, a hardness according to Vickers, Rockwell, Brinell, or a similar test protocol is particularly designated as the hardness.

In order to provide a larger surface due to this (these) coating(s) and to particularly increase the sealing effect and thus the efficiency, one or more coatings, preferably all coatings of the rib arrangement, in a meridian section, have an outer contour that extends outwardly in the radial direction, i.e., with increasing radial distance from the axis of rotation, axially or in the axial direction.

In the present case, a meridian section is particularly understood to be a cross section that contains the axial direction and a radial direction. An outer contour can expand in a radially outward direction monotonically, in particular very monotonically, in a preferred embodiment. In the following, it is particularly understood in the present case that the distance in the axial direction between the two outer flanks of the outer contour, with increasing radial distance to the axis of rotation, at least substantially, continually remains at least the same (monotonic) or in fact continually increases (very monotonic). Equally, however, outer contours are also included whose outer flanks approach each other in limited radial regions. Therefore, in general, an outer contour is to be understood as one that extends outwardly in the radial direction, in particular an outer contour with two opposite-lying outer flanks, whose distance in the axial direction is shorter in a first, shorter distance to the axis of rotation than in a second, longer distance to the axis of rotation.

As a consequence of such a radially outwardly increasing outer contour, the outer flank of the coating of an adjacent rib or coating, viewed in the axial direction, comes close, so that the axial gap between coating and adjacent rib or coating becomes smaller. A radially outwardly larger surface is provided in this way and thus leakage into the intermediate spaces between adjacent ribs is reduced.

In a preferred embodiment, the gap between flanks of adjacent coatings of adjacent ribs of the rib arrangement facing each other at most corresponds to an axial width of a radially outer end face of one of the two adjacent ribs. In the present case, the distance between front and back edges of a radially outer end face of a rib is particularly designated as the axial width. Due to the preferred limiting of the gap to the end-face axial width of a rib, the leakage into the intermediate space between adjacent ribs can be decreased to an extent that is not critical for efficiency. In a preferred enhancement, a gap between flanks of adjacent coatings of adjacent ribs of the rib arrangement facing each other corresponds to at most 75%, and preferably at most 50%, of such an axial width. In general, smaller gaps between coatings are preferred, a gap advantageously having a certain minimum dimension that can amount in particular to at least 20% of an axial width of a radially outer end face of one of the two adjacent ribs, in order avoid chipping of the coating.

In a preferred embodiment, one or more, in particular, all ribs of the rib arrangement in the peripheral direction are inclined by an angle that is not equal to 0° but is smaller than 10° in magnitude, particularly smaller than 5°, and preferably smaller than 3°.

In a preferred embodiment, two or more, in particular, all ribs of the rib arrangement in the radial direction have outer end faces, at least substantially, at the same radial height. Proceeding from these end faces, the ribs extend in the radial direction inwardly to different depths, i.e., they are at different heights in the radial direction. On the one hand, this makes possible the formation of small gaps between the ribs, and on the other hand, this enables an adaptation to blades with varying radial height.

Likewise, in the radial direction, outer end faces of two or more, in particular, all ribs of the rib arrangement may have a different radial height, particularly—at least substantially—lying on a virtual conical surface. Additionally or alternatively, two or more, in particular, all ribs of the rib arrangement in the radial direction may be of different heights.

In a preferred embodiment, the rib arrangement is disposed on a shroud of the rotating blade. In the present case, a shroud is understood to be, in particular, a flange that extends in the axial and peripheral directions, and in a preferred enhancement is applied in form-fitting manner to shrouds of adjacent blades in the peripheral direction. In a preferred enhancement, the shroud can be oblique in the axial direction in order to bear the ribs of different height explained above.

According to another aspect of the present invention, a method is proposed for coating one or preferably more, parallel or successive ribs, particularly chronologically, of a radially outer rib arrangement of a rotating blade, this method being particularly suitable for coating a rotating blade according to the aspect described above.

According to a further aspect, a coating material is sprayed onto the rib arrangement from at least two opposite spraying directions, in particular plasma-sprayed, flame-sprayed, especially high-speed flame-sprayed, detonation-sprayed, cold-gas-sprayed, arc-sprayed, and/or laser-sprayed. In the present case, plasma spraying is particularly understood in that, for example, an arc is generated in a plasma torch between anode(s) and cathode(s) by a voltage, and gas or a gas mixture is conducted through the arc and is ionized in this way. The dissociation or subsequent ionization produces a highly heated, electrically conducting gas of positive ions and electrons. Powder-form coating material can be injected into this plasma jet that is produced and this material is melted by the high plasma temperature. The plasma current entrains the powder particles and flings them onto the rotating blade to be coated. The plasma coating is preferably produced in a normal atmosphere, an inert atmosphere, in vacuum or even under water.

By spraying in a spraying direction inclined to the radial direction, the outer contour extending outwardly in the radial direction can be particularly presented. Comparable to the blowing of snow into ridges by the wind, more coating material is introduced on the outer edges of the end faces of the rotating blade, whereby a corresponding projection of the jet of coating material onto the flank of the rib is adjusted by the inclination of the spraying direction. In addition, adjacent ribs or coatings can partially shade the jet of coating material, so that less coating material is introduced with decreasing radial distance to the axis of rotation.

In a preferred embodiment, the spraying directions are opposite, but of the same magnitude, inclined relative to the radial direction, preferably by a spray angle that is larger in magnitude than 20°, particularly larger than 40°, and/or smaller than 70°, in particular, smaller than 50°. The coating material can be sprayed sequentially or simultaneously from the two spraying directions.

In a preferred embodiment, one or more coatings are post-processed simultaneously or sequentially, after the coating material has been sprayed on. In particular, a radially outer end face of the coatings, for example, can be ground, polished, or otherwise post-processed.

BRIEF DESCRIPTION OF THE DRAWING FIGURES

Figure 2:
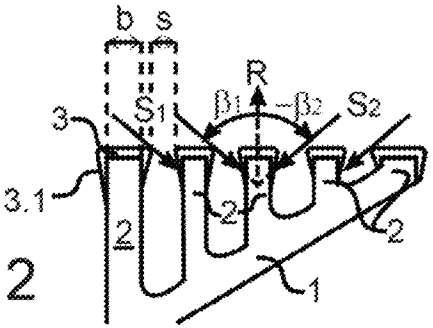
Figure 3:
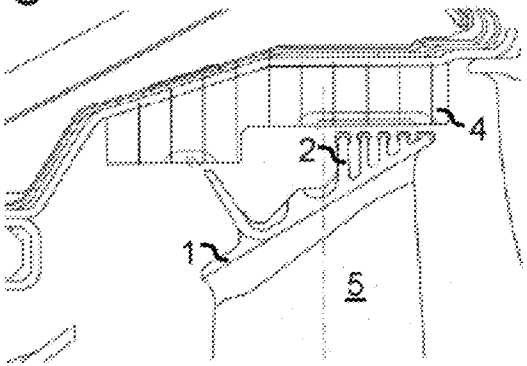
Figure 4:
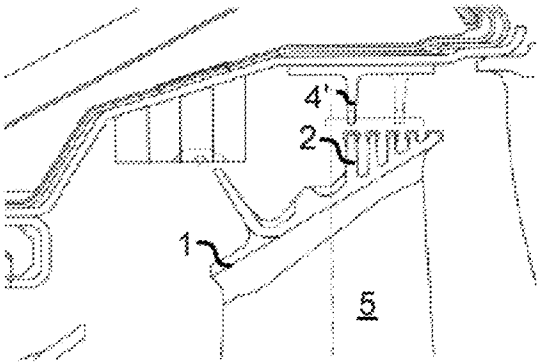

These and other features, aspects, and advantages of the rotating blade will become better understood with reference to the following description, appended claims, and accompanying drawings where:

FIG. 1: the shroud of a rotating blade according to an embodiment of the present invention in a top view counter to a radial direction;

FIG. 2: an enlarged excerpt of FIG. 3 or 4;

FIG. 3: a meridian section of a gas turbine stage according to an embodiment of the present invention; and FIG. 4: a meridian section of a gas turbine stage according to another embodiment of the present invention.

DETAILED DESCRIPTION OF AN EXEMPLARY EMBODIMENT

FIG. 3 shows a meridian section of a gas turbine stage according to an embodiment of the present invention, having a rotating blade 5, on whose oblique shroud 1 is disposed a rib arrangement with five ribs 2 disposed one behind the other in the axial direction. A honeycomb-shaped sealing surface 4 is disposed radially opposite the rib arrangement 2. In the otherwise corresponding embodiment of FIG. 4, a sealing surface 4' with one or two (dashes) counter-rib(s) is provided instead of the honeycomb-shaped sealing surface.

FIG. 2 shows an enlargement of the excerpt of shroud 1 with the rib arrangement. As can be especially seen, on each of the radially outer end faces of ribs 2, which lie at the same radial height so that the ribs have different heights due to the oblique shroud 1, there is disposed a coating 3.

This coating 3 is introduced by means of sequential plasma spraying, first in a first spraying direction $S_1$, and subsequently in an opposite or mirror-symmetrical second spraying direction $S_2$, as indicated by arrows in FIG. 2. The two spraying directions are inclined toward radial direction R, in which ribs 2 extend, by an angle $\beta_1=-\beta_2=45°$.

In this way, coatings 3 that have an outer contour that extends outwardly in the radial direction result on ribs 2, as shown in the meridian section of FIG. 2. In other words, with increasing radial distance from an axis of rotation of the gas turbine (from bottom to top in FIG. 2), the axial distance (horizontal in FIG. 2) increases between outer flanks 3.1 of the outer contour of a coating 3; the coating will be broader radially outwardly in the axial direction. Correspondingly, a gap s between the outer flanks of adjacent coatings is reduced and radially outwardly amounts to only approximately 75% of the axial width b of the radially outer end face of the wider of the two adjacent ribs 2 (left in FIG. 2).

A substantially planar end surface of coatings 3 can be presented by superimposing the oppositely-directed two spraying directions $S_1$, $S_2$. Likewise, the coating, in particular its radially outer end face (top in FIG. 2) can be post-processed, ground in particular, after it has been sprayed on.

It can be recognized particularly in FIG. 2 that an extensive sealing surface, particularly sealed to fluids, is made available by coatings 3 that widen in the radial direction outwardly or with increasing radial distance from the axis of rotation, the weight of the rib arrangement remaining advantageously small due to the intermediate spaces between the ribs.

As can be recognized in FIG. 1, ribs 2 are inclined toward the peripheral direction U by an angle $\alpha$ that amounts to 2° in the example of embodiment. The peripheral direction U as well as a radial direction R are indicated in the figures for illustration, whereby FIGS. 2 to 4 can each represent a section horizontal to the drawing plane of FIG. 1; an axial direction thus runs horizontally from left to right in all figures. The sprayed layer is thus not shown.

What is claimed is:

1. A rotating blade for a compressor or turbine stage of a gas turbine, comprising a radially outer rib arrangement with at least one rib, having a radially outer end face and adjacent flanks, onto which a coating is disposed on the radially outer end face and a portion of the flanks wherein, in a meridian section, the coating has an outer contour, which extends outwardly in the radial direction and is broader in the axial direction as a radial distance increases.

2. The rotating blade according to claim 1, wherein the rib arrangement has two or more ribs disposed behind one another in the axial direction, whereby a coating is disposed on each of at least two adjacent ribs, and whereby at least one gap between flanks of the adjacent coatings facing one another corresponds at most to an axial width of the radially outer end face of one of the two adjacent ribs up to about 75% of the axial width.

3. The rotating blade according to claim 1, wherein at least one rib of the rib arrangement is inclined in the peripheral direction (U) by an angle ($\alpha$) not equal to 0°, but which is smaller than 10° in magnitude.

4. The rotating blade according to claim 1, wherein at least two ribs of the rib arrangement have radially outer end faces in radial direction (R), which, at least substantially, lie at the same radial height, and, proceeding from the end face, are of inwardly different heights, in the radial direction.

5. The rotating blade according to claim 1, wherein at least two ribs of the rib arrangement, in radial direction (R), have radially outer end faces that lie at different radial heights, whereby the ribs are of different heights in the radial direction.

6. The rotating blade according to claim 1, wherein the rib arrangement is disposed on a shroud, which is oblique in the axial direction of the rotating blade.

7. The rotating blade according to claim 1, wherein the coating has a greater hardness than the rib on which it is disposed.

8. The rotating blade according to claim 1, wherein at least one rotating blade is configured as a rotating blade in gas turbine turbomachine.

9. A method for coating at least one rib of a radially outer rib arrangement of a rotating blade, comprising the steps of:

providing a rib arrangement; and spraying a coating material onto the rib arrangement from two opposite spraying directions ($S_1$, $S_2$).

10. The method according to claim 9, wherein the spraying directions are inclined toward the radial direction (R) by spraying angles ($\beta_1$, $\beta_2$) that are particularly the same in magnitude.

11. The method according to claim 9, wherein an angle of spraying direction ($\beta_1$, $\beta_2$) is between about 20° and about 70° in magnitude.

12. The method according to claim 9, wherein the coating material is sprayed on thermally, in a technique selected from the group consisting of plasma-sprayed, flame-sprayed, high-speed flame-sprayed, detonation-sprayed, cold-gas-sprayed, arc-sprayed, laser-sprayed and combinations thereof.

13. The method according to claim 9 wherein the coating is post-processed after it has been sprayed on.

* * * * *